US009790793B2

(12) United States Patent
Jung

(10) Patent No.: US 9,790,793 B2
(45) Date of Patent: Oct. 17, 2017

(54) GAS TURBINE HAVING DAMPING CLAMP

(71) Applicant: DOOSAN HEAVY INDUSTRIES & CONSTRUCTION CO., LTD., Gyeongsangnam-do (KR)

(72) Inventor: Sung Chul Jung, Daejeon (KR)

(73) Assignee: Doosan Heavy Industries & Construction Co., Ltd., Gyeongsangnam-do (KR)

( * ) Notice: Subject to any disclaimer, the term of this patent is extended or adjusted under 35 U.S.C. 154(b) by 345 days.

(21) Appl. No.: 14/588,529

(22) Filed: Jan. 2, 2015

(65) Prior Publication Data

US 2015/0198044 A1 Jul. 16, 2015

(30) Foreign Application Priority Data

Jan. 15, 2014 (KR) ..... 10-2014-0005045

(51) Int. Cl.
*F01D 5/06* (2006.01)
*F01D 5/08* (2006.01)
*F01D 5/10* (2006.01)

(52) U.S. Cl.
CPC ..... *F01D 5/066* (2013.01); *F01D 5/081* (2013.01); *F01D 5/10* (2013.01)

(58) Field of Classification Search
CPC ..... F01D 5/066; F01D 5/081; F01D 5/085; F01D 5/10; F01D 11/005
USPC ..... 415/116
See application file for complete search history.

(56) References Cited

U.S. PATENT DOCUMENTS 4,181,038 A * 1/1980 Becker ..... F01D 25/04 74/574.2
4,541,774 A * 9/1985 Rieck ..... F01D 5/085 415/115
4,807,433 A * 2/1989 Maclin ..... F01D 5/081 415/115
4,882,902 A * 11/1989 Reigel ..... F01D 5/082 415/115
7,708,519 B2 * 5/2010 Mignano ..... F01D 5/081 415/115
8,506,239 B2 8/2013 Benkler et al.
8,668,437 B1 * 3/2014 Liang ..... F01D 5/14 415/115
2010/0092293 A1 * 4/2010 Benkler ..... F01D 5/066 416/95
2010/0166559 A1 7/2010 Ahaus et al.

* cited by examiner

*Primary Examiner* — Woody Lee, Jr.
*Assistant Examiner* — Eric Zamora Alvarez
(74) *Attorney, Agent, or Firm* — Baker & McKenzie LLP

(57) ABSTRACT

An exemplary gas turbine includes a rotor unit, a tie-bolt, a cooling air pipe, and a clamping member. The rotor unit includes rotor blades and rotor disks. The rotor blades are arranged on outer circumferential surfaces of the rotor blades. The tie-bolt extends along the central axis of the rotor unit through the rotor disks and fastens the rotor disks. The cooling air pipe has the tie-bolt arranged therethrough and forms a ring-shaped cooling air flow path in an internal space thereof with the tie-bolt through which a cooling air is passed. The clamping member is arranged in the ring-shaped cooling air flow path so as to support the tie-bolt with respect to the cooling air pipe.

20 Claims, 17 Drawing Sheets

RELATED ART

RELATED ART

GAS TURBINE HAVING DAMPING CLAMP

CROSS-REFERENCE(S) TO RELATED APPLICATIONS

This application claims priority to Korean Patent Application No. 10-2014-0005045, filed on Jan. 15, 2014, the disclosure of which is incorporated herein by reference in its entirety.

BACKGROUND

Exemplary embodiments of the present disclosure relate to a gas turbine, and more particularly, to a gas turbine which includes a plurality of compressor rotors and turbine rotors connected to each other through a tie-bolt, and has a cooling air flow path formed on the circumference of the tie-bolt.

In general, a gas turbine refers to a kind of internal combustion engine which mixes fuel with air compressed at high pressure by a compressor, burn the mixture to generate high-temperature and high-pressure combustion gas, and expands the combustion gas to convert thermal energy into mechanical energy. The compressor and the turbine acquire rotary power from a rotor.

In such a compressor rotor and a turbine rotor, a plurality of rotor disks having a plurality of compressor blades arranged on the outer circumferential surfaces thereof are connected to each other so as to be integrally rotated. A plurality of turbine rotor disks having a plurality of turbine blades arranged on the outer circumferential surface thereof are connected to each other so as to be integrally rotated. The compressor rotor disks and the turbine rotor disks are fastened to each other through a tie-bolt extended through the central portions of the compressor rotor disks and the turbine rotor disks.

However, there is a trend that gas turbines are increasing in size and efficiency, and overall lengths of the gas turbines have also been increased. This makes it difficult to rotatably support the tie-bolt which is rotated at high speed with the compressor rotor and the turbine rotor of the turbine.

Furthermore, a support unit for the rotating tie-bolt may not be easily positioned in a space between the compressor rotor and the turbine rotor along the central axis of the gas turbine, that is, a space in which combustors are radially arranged on the outer circumference of the gas turbine.

As illustrated in FIG. 1, the rotor assembly 1 includes a compressor rotor 2 including a plurality of compressor rotor disks 21, a turbine rotor 3 including a plurality of turbine rotor disks 31, and a single tie-bolt 5 extended through the compressor rotor 2 and the turbine rotor 3. The compressor rotor 2 and the turbine rotor 3 are fastened to each other through the tie-bolt 5, a compressor-side rotor component 6, and a turbine-side rotor component 7. The tie-bolt 5 is supported by a support wheel 41 provided in a hollow shaft 4 which forcibly connects the compressor rotor 2 and the turbine rotor 3 to each other. The rotor assembly 1 has a problem in that it is difficult to form a flow path for transferring the low-temperature air extracted from the compressor rotor 2 to the turbine rotor 3 so as to utilize the low-temperature air as cooling air for the turbine rotor 3.

As illustrated in FIG. 2A, a compressor rotor 2 and a turbine rotor (not illustrated) are fastened through a tie-bolt 5 passing through the compressor rotor 2 including a plurality of compressor rotor disks 21 having a plurality of compressor blades 22 arranged on the outer circumferential surfaces thereof, similar to the structure illustrated in FIG. 1. Furthermore, two cooling air pipes P1 and P2 are arranged on the circumference of the tie-bolt 5 such that flow paths F1 and F2 of cooling air transferred from through-holes 23 at different positions of the compressor rotor 2 are formed on the circumference of the tie-bolt 5. In addition, two clamping members 8 are provided on the outer circumferential surface of the tie-bolt 5 and the outer circumferential surface of the inner cooling air pipe P1, respectively, in order to support the tie-bolt 5.

Referring also to FIG. 2B, each of the clamping members 8 includes a cylindrical support ring 81, a plurality of support arms 82 extended from the support ring 81, and a support surface 83 in contact with the inner circumferential surface of the inner pipe P1 and the inner circumferential surface of the outer pipe P2. A recess 84 forming the flow paths F1 and F2 of cooling air is formed between the respective support arms 82.

In the clamping member 8, however, the width or thickness of the support arms 82 or the number of the support arms 82 must be increased to maintain the stiffness of the support arms 82. Such a structure may serve as an element which directly interferes with the cooling air paths F1 and F2 provided in the cooling air pipes P1 and P2.

That is, since the clamping members 8 are arranged in the cooling air flow paths F1 and F2 and the tie-bolt and the clamping members are rotated at high speed, the support arms 82 having a constant width interfere with a cooling air flow.

Furthermore, it is difficult to transfer low-temperature and low-pressure air extracted from the compressor rotor at the front stage, in which the pressure is relatively low, to the turbine rotor without a separate pressurizing unit.

BRIEF SUMMARY

The present disclosure has been made in view of the above problems, and it is an object of the present disclosure to provide a gas turbine which includes a clamping member arranged in a cooling air flow path formed on the outer circumferential surface of a tie-bolt, that supports the tie-bolt to effectively reduce vibrations, pressurizes cooling air extracted from a low-temperature and low-pressure compressor rotor using the clamping member, and transfers the pressurized cooling air to a turbine rotor, thereby increasing the entire efficiency thereof.

Also, it is an object of the present disclosure to provide a gas turbine which cools a high-temperature turbine rotor through air extracted from a low-temperature and low-pressure compressor rotor using a plurality of clamping members having the same or different air blowing capacities, thereby improving the cooling performance and the entire efficiency of an engine.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, a gas turbine may include: a rotor unit including a plurality of rotor blades and a plurality of rotor disks having the plurality of rotor blades arranged on an outer circumferential surfaces thereof; a tie-bolt extended along a central axis of the rotor unit through the plurality of rotor disks, and fastening the plurality of rotor disks; a cooling air pipe arranged so that the tie-bolt passes therethrough, and forming a ring-shaped cooling air flow path, through which a cooling air is passed, in an internal space thereof with the tie-bolt; and a clamping member arranged in the ring-shaped cooling air flow path so as to support the tie-bolt with respect to the cooling air pipe. The cooling air may be passed through the clamping member, and the clamping member may be rotated to pressurize the cooling air.

The rotor unit may include a compressor rotor, a turbine rotor, and a hollow shaft which forcibly connects the compressor rotor and the turbine rotor, the cooling air pipe may be extended from the compressor rotor disk through the hollow shaft to the turbine rotor disk, and the clamping member may be arranged at an axial position corresponding to the hollow shaft, based on the central axis.

The clamping member may include: an inner ring closely attached to an outer circumferential surface of the tie-bolt; an outer ring closely attached to an inner circumferential surface of the cooling air pipe; and a plurality of support arms each having one end connected to the inner ring and the other end connected to the outer ring, and wherein the plurality of support arms may have an impeller shape to pressurize the cooling air.

At least one of a leading edge and a trailing edge of the support arm may be formed in a linear shape, and an extension of the linear leading edge or the trailing edge may form a predetermined crossing angle with a straight line perpendicular to the central axis, the straight line passing through the central axis of the tie-bolt.

At least one of a leading edge and a trailing edge of the support arm may be formed in a curved shape, and an extension passing through one end and the other end of the leading edge or the trailing edge of the support arm may form a predetermined crossing angle with a straight line perpendicular to the central axis, the straight line passing through the central axis of the tie-bolt.

The inner ring and the outer ring may be arranged at the same axial position or different axial positions, based on the central axis.

The inner ring may have a shape of which an inner diameter gradually decreases along the central axis, and the tie-bolt may include a stopper having a shape corresponding to the shape of the inner ring of which the inner diameter gradually decreases.

The inner ring may have a shape in which an inner diameter decreases along the central axis while forming a stepped portion, and the tie-bolt may include a stopper having a shape corresponding to the stepped portion of the inner ring.

The clamping member may further include one or more stopper protrusions protruding from an inner surface of the inner ring toward the inside, and the tie-bolt may include a groove provided at a position corresponding to the stopper protrusion.

In accordance with another aspect of the present disclosure, a gas turbine may include: a rotor unit including a plurality of rotor blades and a plurality of rotor disks having the plurality of rotor blades arranged on an outer circumferential surfaces thereof; a tie-bolt extended through a plurality of rotor disks so as to fasten the plurality of rotor disks; a first cooling air pipe arranged so that the tie-bolt passes therethrough, and forming a first ring-shaped cooling air flow path, through which cooling air is passed, in an internal space thereof with the tie-bolt; a second cooling air pipe arranged so that the first cooling air pipe passes therethrough, and forming a second ring-shaped cooling air flow path, through which cooling air is passed, in an internal space thereof with the first cooling air pipe; a first clamping member arranged in the first ring-shaped cooling air flow path so as to support the tie-bolt with respect to the first cooling air pipe; and a second clamping member arranged in the second ring-shaped cooling air flow path so as to support the first cooling air pipe with respect to the second cooling air pipe. The cooling air may be passed through the first and second clamping members, and the first and second clamping members may be rotated to pressurize the cooling air.

The rotor unit may include a compressor rotor, a turbine rotor, and a hollow shaft which forcibly connects the compressor rotor and the turbine rotor, the first and second cooling air pipes may be extended from the compressor rotor disk through the hollow shaft to the turbine rotor disk, and the first and second clamping members may be arranged at axial positions corresponding to the hollow shaft, based on the central axis.

The compressor rotor may include a plurality of compressor rotor disks and the turbine rotor may include a plurality of turbine rotor disks, and a part of the cooling air pressurized by the compressor rotor may be extracted from the compressor rotor disk, and pressurized and transferred to the turbine rotor disk through the first and second cooling air pipes.

The cooling air passing through the first cooling air pipe and the cooling air passing through the second cooling air pipe may be extracted from the compressor rotor disk, and pressurized and transferred to the turbine rotor disk, and the cooling air passing through the first cooling air pipe and the cooling air passing through the second cooling air pipe may be extracted from different extraction positions.

The cooling air passing through the first cooling air pipe may be extracted from a first extraction position of the compressor rotor, the cooling air passing through the second cooling air pipe may be extracted from a second extraction position of the compressor rotor, and the first extraction position may be set in an upstream side of the second extraction position.

The first clamping member may be arranged at a central axial position which is more adjacent to the compressor rotor than the second clamping member.

The first clamping member may include: a first inner ring closely attached to an outer circumferential surface of the tie-bolt; a first outer ring closely attached to an inner circumferential surface of the first cooling air pipe; and a plurality of first support arms each having one end connected to the first inner ring and the other end connected to the first outer ring, and the second clamping member may include: a second inner ring closely attached to an outer circumferential surface of the first cooling air pipe; a second outer ring closely attached to an inner circumferential surface of the second cooling air pipe; and a plurality of second support arms each having one end connected to the second inner ring and the other end connected to the second outer ring. The first and second support arms may have an impeller shape to pressurize the cooling air.

The first and second clamping members may have different air blowing capacities from each other.

A number of the first support arms of the first clamping member may be different from a number of the second support arms of the second clamping member.

A radial length of the first support arm of the first clamping member may be different from a radial length of the second support arm of the second clamping member.

A central axial width of the first support arm of the first clamping member may be different from a central axial width of the second support arm of the second clamping member, based on the central axis.

It is to be understood that both the foregoing general description and the following detailed description of the present disclosure are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
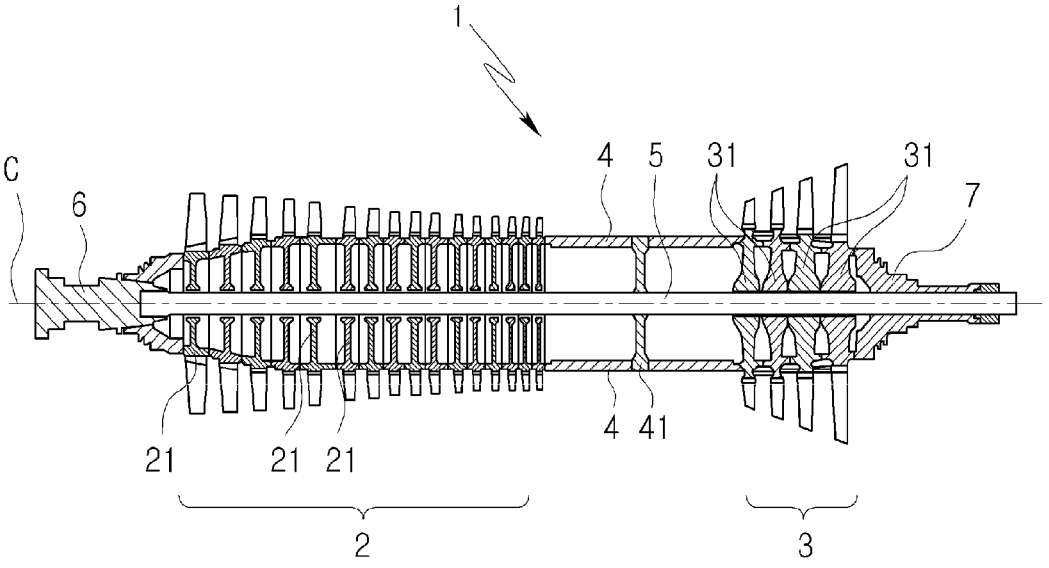
FIG. 1 is a cross-sectional view of a rotor assembly according to the related art.
Figure 2A:
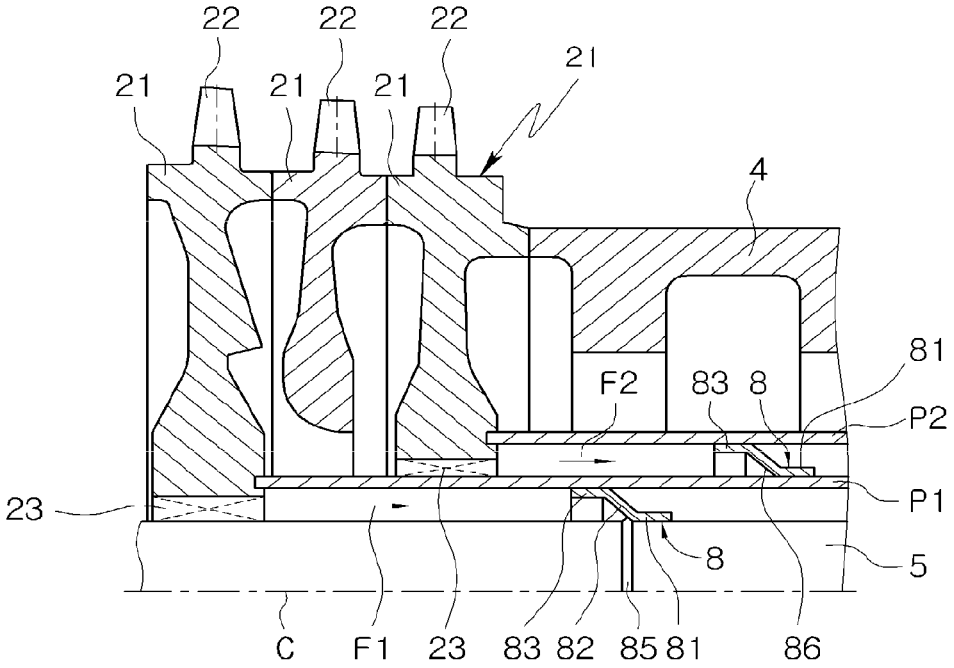
FIGS. 2A and 2B are cross-sectional and perspective views of a clamping member according to the related art.
Figure 2B:
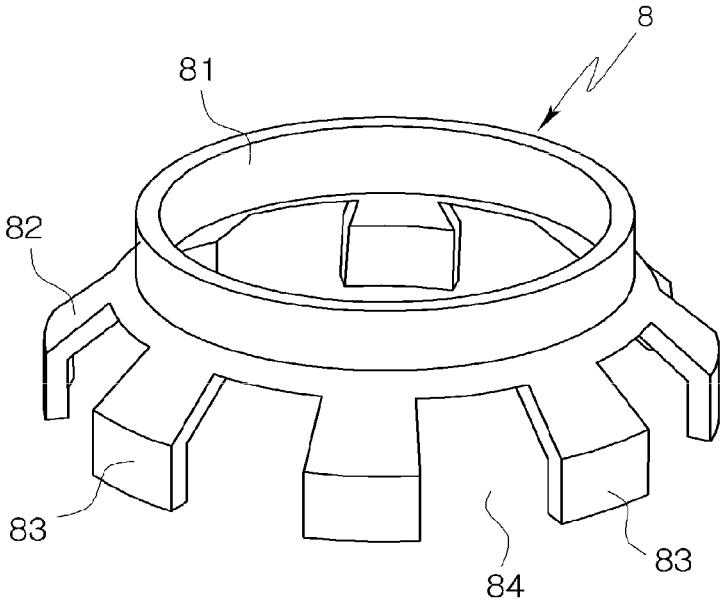
RELATED ART FIG. 2B

Hereafter, embodiments of the present disclosure will be described with reference to the accompanying drawings.

The present disclosure may include various modifications and various embodiments, and thus specific embodiments will be illustrated in the drawings and described in the detailed descriptions. However, the present disclosure is not limited to specific embodiments, and may include all of variations, equivalents, and substitutes within the scope of the present disclosure.

When the embodiments of the present disclosure are described, terms such as first and second may be used to described various elements, but the embodiments are not limited to the terms. The terms are used only to distinguish one element from another element. For example, a first element may be referred to as a second element, without departing from the scope of the present invention. Similarly, a second element may be referred to as a first element.

When an element is referred to as being connected or coupled to another element, it should be understood that the former can be directly connected or coupled to the latter, or connected or coupled to the latter via an intervening element therebetween. On the other hand, when an element is referred to as being directly connected to another element, it may be understood that no intervening element exists therebetween.

The terms used in this specification are used only to describe specific embodiments, but do not limit the present invention. The terms of a singular form may include plural forms unless referred to the contrary. The terms of a singular form may include plural forms unless referred to the contrary.

In this specification, the meaning of include or comprise specifies a property, a number, a step, a process, an element, a component, or a combination thereof, but does not exclude one or more other properties, numbers, steps, processes, elements, components, or combinations thereof.

The terms including technical or scientific terms have the same meanings as the terms which are generally understood by those skilled in the art to which the present disclosure pertains, as long as they are differently defined. The terms defined in a generally used dictionary may be analyzed to have meanings which coincide with contextual meanings in the related art. As long as the terms are not clearly defined in this specification, the terms may not be analyzed as ideal or excessively formal meanings.

Furthermore, the following embodiments are provided for clear understanding of those skilled in the art, and the shapes and sizes of components in the drawings are exaggerated for clarity of description.

Figure 3:
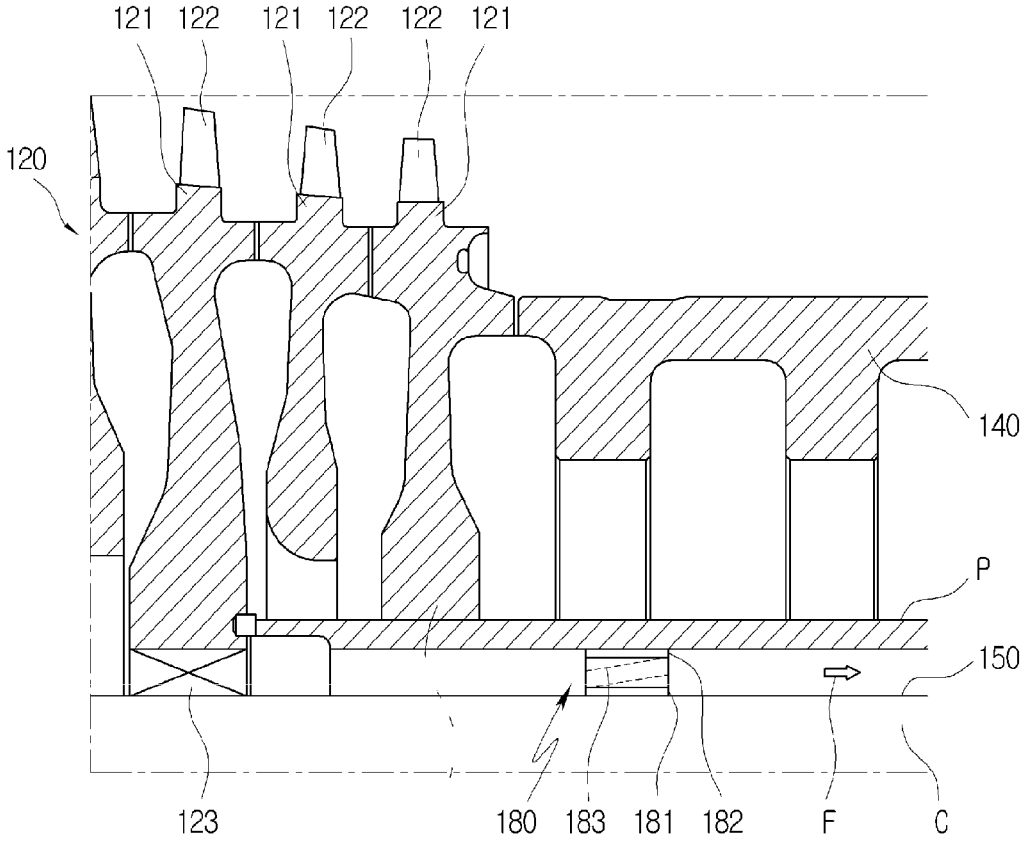
FIG. 3 is a cross-sectional view of a rotor assembly and a clamping member according to a first embodiment of the present disclosure.
Figure 4:
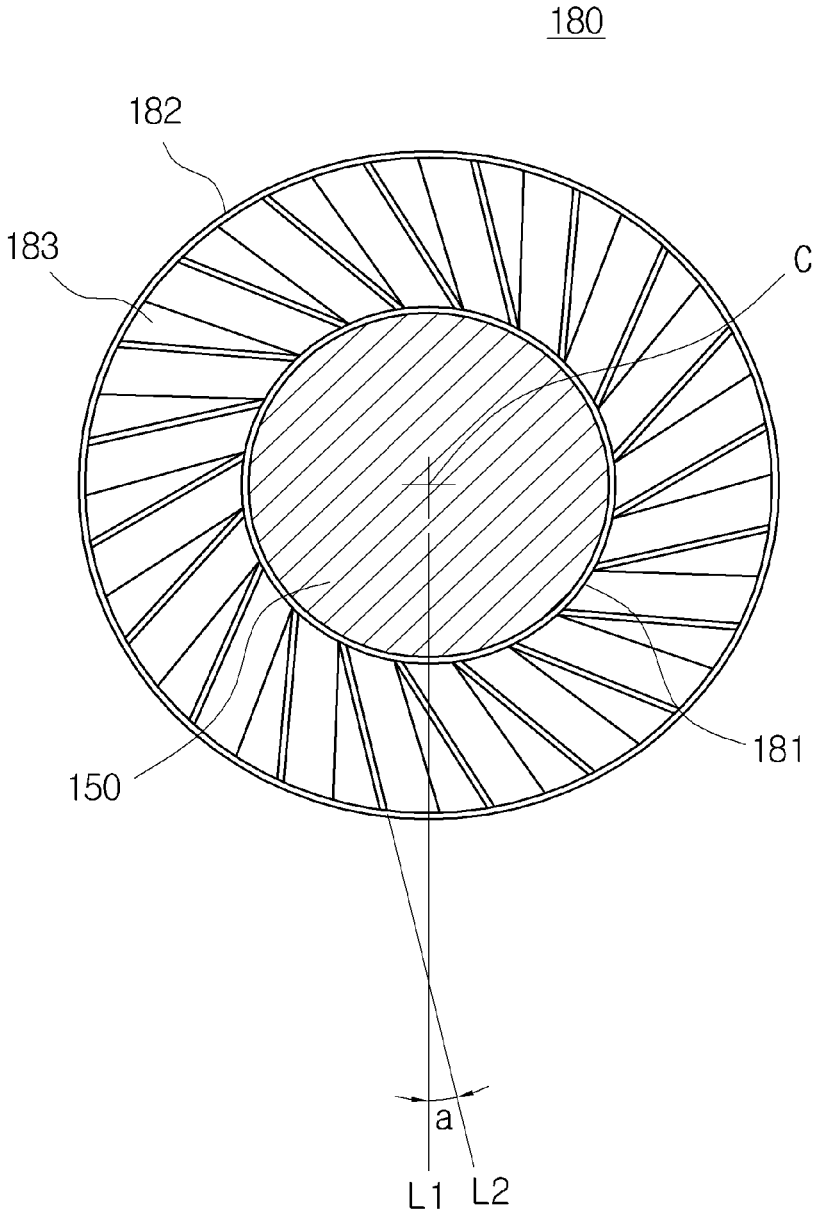
FIGS. 4 and 5 are front and perspective views of a clamping member according to the first embodiment of the present disclosure.
Figure 5:
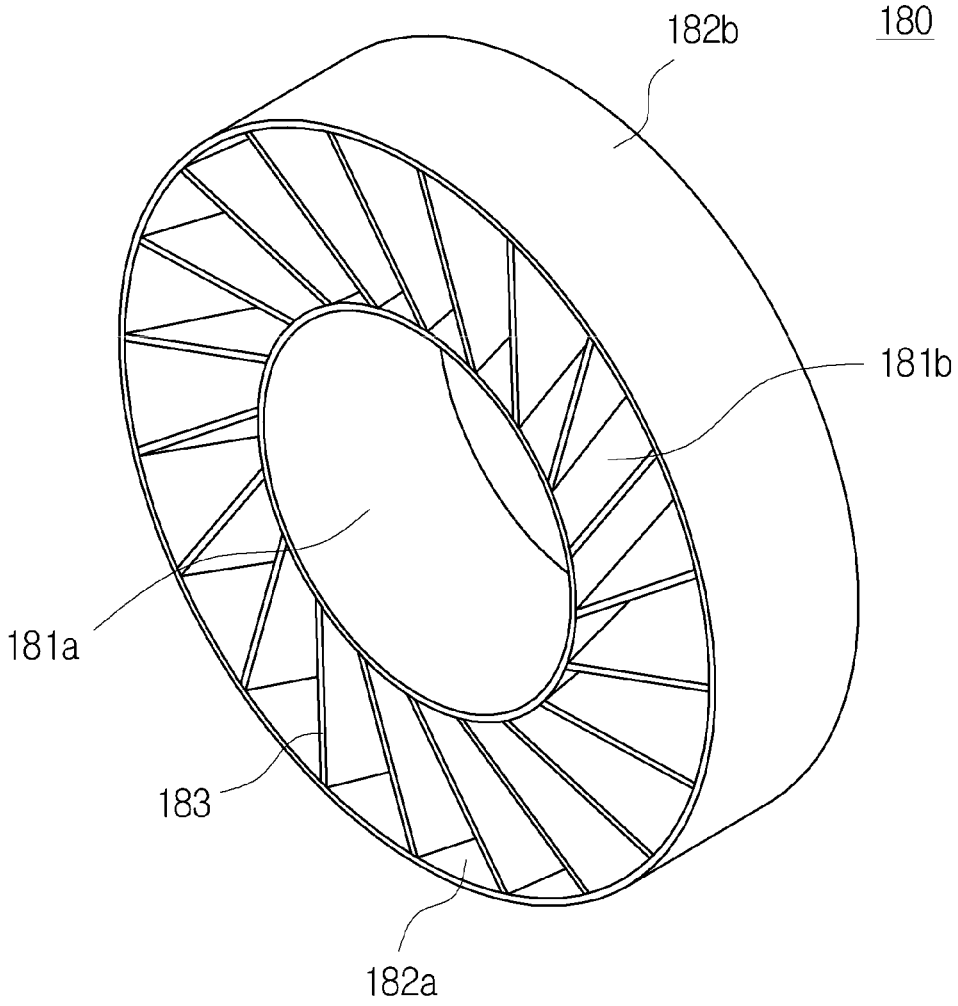

FIG. 3 is a cross-sectional view of a rotor assembly and a clamping member according to a first embodiment of the present disclosure. FIGS. 4 and 5 are front and perspective views of the clamping member according to the first embodiment of the present disclosure.

Referring to FIG. 3, a gas turbine according to the embodiment of the present disclosure includes a rotor unit, a tie-bolt 150, a cooling air pipe P, and a clamping member 180. The rotor unit includes a plurality of rotor blades and a plurality of rotor disks having the plurality of rotor blades arranged on the outer circumferential surface thereof. The tie-bolt 150 extends along the central axis of the rotor unit through the plurality of rotor disks so as to fasten the plurality of rotor disks. The cooling air pipe P has the tie-bolt 150 arranged therethrough and forms a ring-shaped cooling air flow path in the internal airspace between the cooling air pipe P and the tie-bolt 150. Cooling air is passed through the ring-shaped cooling air flow path. The clamping member 180 is arranged in the ring-shaped cooling air flow path so as to support the tie-bolt 150 with respect to the cooling air pipe P.

The rotor unit includes a compressor rotor 120 and a turbine rotor (not illustrated). The compressor rotor 120 compresses air to be supplied to a combustor which will be described below. Turbine rotor is rotated while high-temperature and high-pressure combustion gas generated by the combustor (not illustrated) passes through the turbine rotor.

The compressor rotor 120 may be implemented with an axial compressor and may include a plurality of compressor rotor disks 121 and a plurality of compressor blades 122. The plurality of compressor rotor disks 121 may be integrally rotated in a state where one surface of a compressor rotor disk 121 and the opposite surface of another compressor rotor disk 121 are coupled to each other. The plurality of compressor blades 122 may be arranged at even intervals on the outer circumferential surfaces of the compressor rotor disks 121. The compressor rotor 120 serves to compress air introduced from outside at high pressure and transfer the compressed air to the combustor. Between the respective compressor blades 122 adjacent to each other, a compressor vane (not illustrated) is alternately arranged. A pair of the compressor blade 122 and the compressor vane form one stage.

The combustor (not illustrated) is arranged at the rear of the compressor rotor 120, and serves to mix fuel with the air compressed by the above-described compressor rotor 120 and generate high-temperature and high-pressure combustion gas. The combustor includes a plurality of combustor members arranged at even intervals on the circumference of the rotor assembly.

The turbine rotor (not illustrated) is rotated by the high-temperature and high-pressure combustion gas generated by the above-described combustor, and includes a plurality of turbine rotor disks and a plurality of turbine blades, similar to the compressor rotor 120. The plurality of turbine rotor disks are integrally rotated in a state where one surface of a turbine rotor disk and the opposite surface of another turbine rotor disk are coupled to each other. The plurality of turbine blades may be arranged at even intervals on the outer circumferential surfaces of the turbine rotor disks.

The turbine rotor is rotated together with the above-described compressor rotor 120, and includes a hollow shaft 140 as a member for connecting the turbine rotor and the compressor rotor 120, as illustrated in FIG. 3. The above-described combustor members are arranged at even intervals on the outer circumferential surface of the hollow shaft 140.

The tie-bolt 150 extends along the central axis of the compressor rotor 120 and the turbine rotor through the plurality of compressor rotor disks 121 and the plurality of turbine rotor disks. The tie-bolt 150 may fasten the compressor rotor disks 121 and the turbine rotor disks by applying an axial compressive force to the assembly of the compressor rotor disks 121 and the turbine rotor disks.

The cooling air pipe P includes a cooling air flow path F formed therein, that may extract a part of the air compressed through the compressor rotor 120 from the compressor rotor disks 121 and utilize the extracted air as cooling air for cooling the turbine rotor. The cooling air flow path F extends to the turbine rotor disks through the hollow shaft 140 from the compressor rotor disks while connecting the compressor rotor 120 and the turbine rotor.

More specifically, as the tie-bolt 150 is disposed through the cooling air pipe P, the ring-shaped cooling air flow path F through which the cooling air is passed is formed in the space between the cooling air pipe P and the tie-bolt 150. As illustrated in FIG. 3, compressed air extracted from a compressor rotor disk 121 is passed through a through-hole 123 formed in the compressor rotor disk 121, transferred into the cooling air pipe P having the ring-shaped cooling air path formed therein, and finally transferred to the turbine rotor.

The clamping member 180 is arranged in the cooling air flow path F formed by the cooling air pipe and the tie-bolt 150, and serves to support the tie-bolt 150 with respect to the cooling air pipe P.

That is, in order to form the ring-shaped cooling air flow path F as illustrated in FIG. 3, the outer circumferential surface of the tie-bolt 150 and the inner circumferential surface of the cooling air pipe P are preferably supported at a predetermined interval from each other and provide some or complete isolation from each other. Thus, when the rotor unit is rotated at high speed, a unit for supporting the tie-bolt 150 rotates together with the rotor unit and is disposed in the internal space of the cooling air pipe P, or more particularly, a portion corresponding to the above-described hollow shaft 140. The clamping member 180 according to the embodiment of the present disclosure is arranged in the cooling air flow path F so as to support the outer circumferential surface of the tie-bolt 150 with respect to the inner circumferential surface of the cooling air pipe P, thereby effectively absorbing vibrations generated when the tie-bolt 150 is rotated.

Furthermore, the clamping member 180 according to the embodiment of the present disclosure is formed in such a manner that the cooling air passes and flows therethrough. In particular, when the rotor assembly is operated at the same time, that is, when the clamping member 180 is rotated, the cooling air passing through the clamping member 180 is pressurized by the rotation of the clamping member 180.

The clamping member 180 according to the first embodiment of the present disclosure, which may provide the pressurization effect for the cool air, includes an inner ring 181, an outer ring 182, and a plurality of support arms 183. The inner ring 181 is formed in a cylindrical shape, and closely attached to the outer surface of the tie-bolt 150. The outer ring 182 is formed in a cylindrical shape, and closely attached to the inner circumferential surface of the cooling air pipe P. Each of the support arms 183 has one end connected to the inner ring 181 and the other end connected to the outer ring 182. The support arm 183 may have an impeller shape to pressurize the cooling air passing through the clamping member 180.

Furthermore, in order to improve or maximize the vibration absorption effect, at least one of the leading edge and the trailing edge of the support arm 183 may be formed in a linear shape as illustrate in FIGS. 4 and 5. An extension L2 of the linear leading edge or trailing edge may be set to form a crossing angle (a) with a straight line L1 perpendicular to the central axis of the tie-bolt, where the straight line L1 passes through the central axis of the tie-bolt.

That is, the linear leading edge or trailing edge of the support arm 183 is inclined at the predetermined angle with respect to the radial direction. Thus, although the clamping member 180 is arranged in the cooling air flow path F having a relatively small width, it is possible to increase the spring function of the support arm 183 to absorb vibrations which are generated in the direction perpendicular to the central axis C.

The inner ring 181, the outer ring 182, and the support arm 183 of the clamping member 180 may be formed of a metallic material having a predetermined stiffness and a predetermined thickness to endure high temperatures. One end and the other end of the support arm 183 may be reliably fixed to the outer circumferential surface 181*b* of the inner ring 181 and the inner circumferential surface 182*a* of the outer ring 182 through a welding method.

Figure 6:
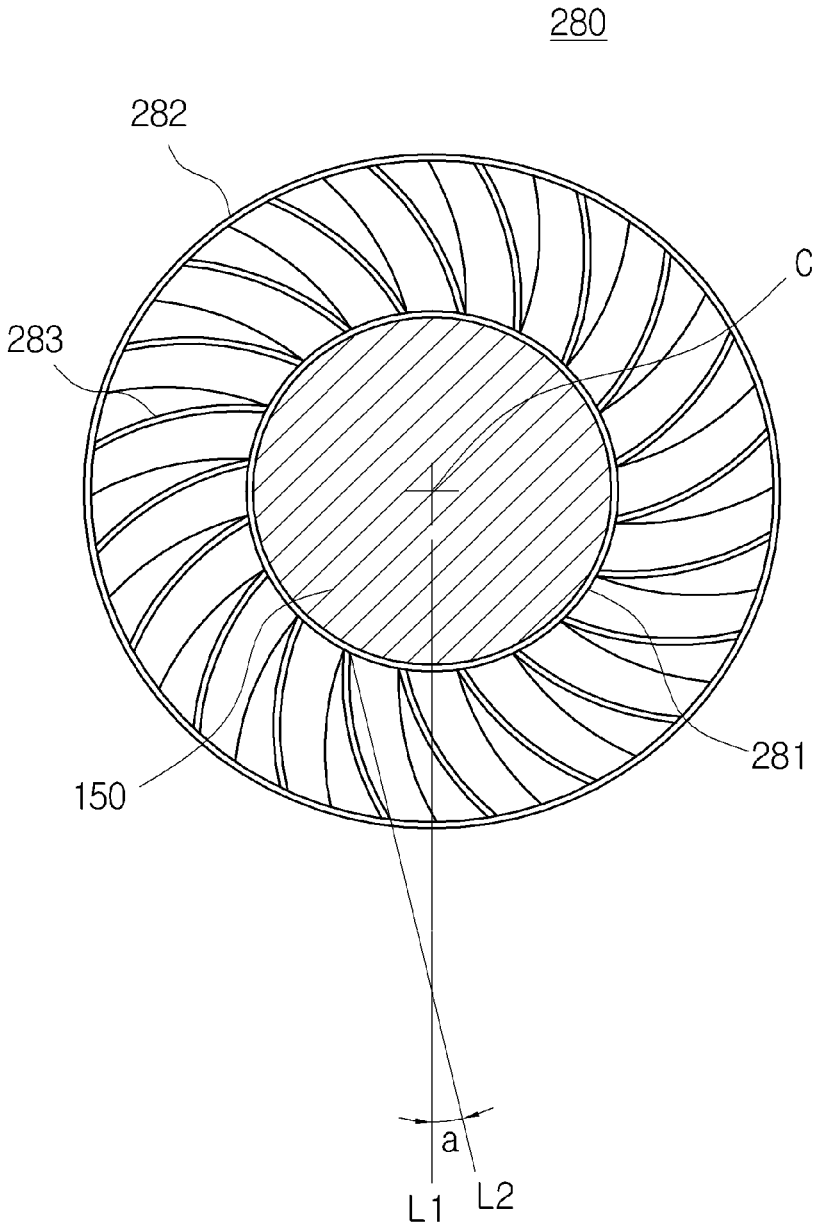
FIGS. 6 and 7 are front and perspective views of a clamping member according to a second embodiment of the present disclosure.
Figure 7:
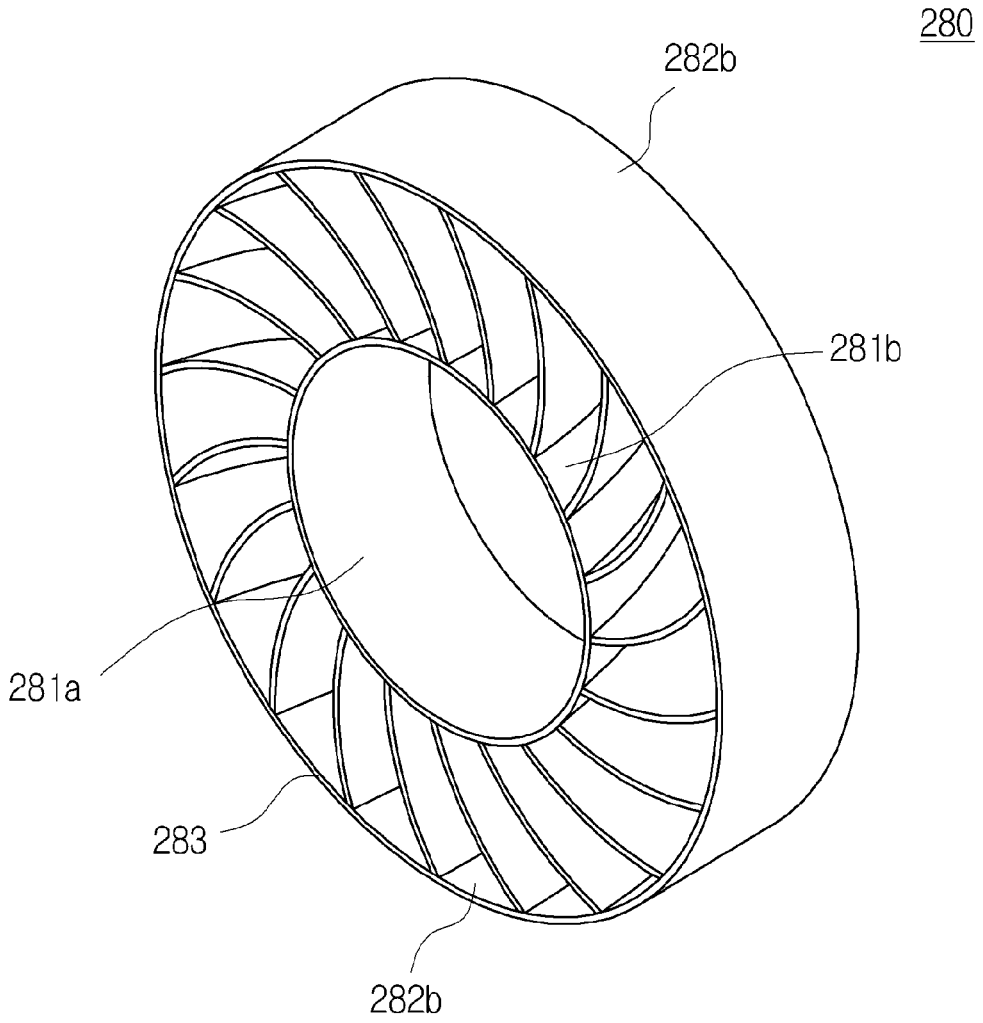

FIGS. 6 and 7 are front and perspective views of a clamping member 280 according to a second embodiment of the present disclosure.

Referring to FIGS. 6 and 7, at least one of the leading edge and the trailing edge of a support arm 283 of the clamping member 280 according to the second embodiment of the present disclosure may be formed in a curved shape, and an extension L2 passing through one end and the other end of the support arm 283 may be set to form a predetermined crossing angle (a) with a straight line L2 perpendicular to the central axis of the tie-bolt 150, where the straight line L2 passes through the central axis of the tie-bolt 150.

As the leading edge or trailing edge of the support arm 283 is formed in a curved shape between the inner ring 281 and the outer ring 282, the spring function of the support arm 283 for absorbing vibrations generated in the direction perpendicular to the central axis C may be increased, like the clamping member 180 according to the first embodiment of the present disclosure.

Furthermore, as illustrated in FIGS. 6 and 7, the predetermined crossing angle (a) formed between the extension L2 and the straight line L1 may improve the spring function of the support arm 283 for absorbing vibrations. In addition, the crossing angle (a), the number of support arms 183 or 283, the distance between the leading edge and the trailing edge, or the thickness of the support arms 183 or 283 may be adjusted to enhance or optimize the vibration absorption effect. Such additional adjustments also belong to the scope of the present disclosure.

Figure 8A:
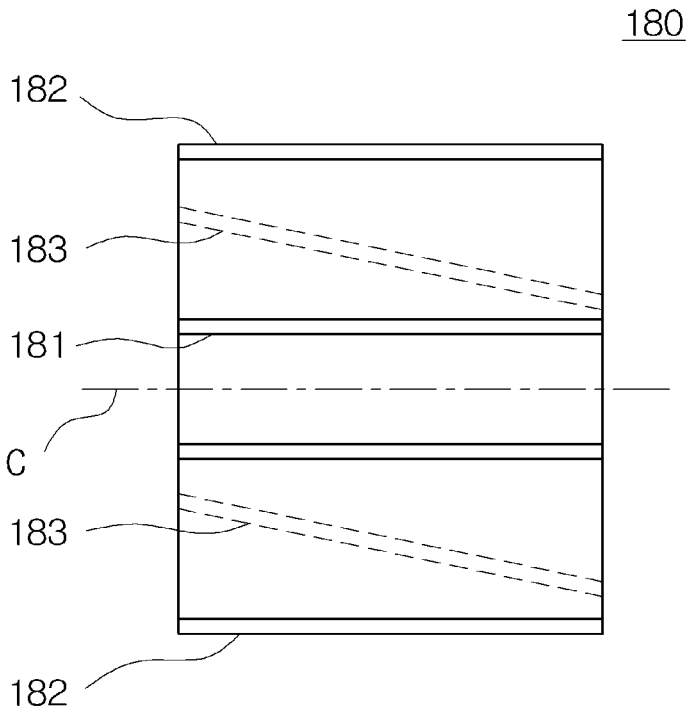
FIGS. 8A and 8B are cross-sectional views of clamping members according to a third embodiment of the present disclosure.
Figure 8B:
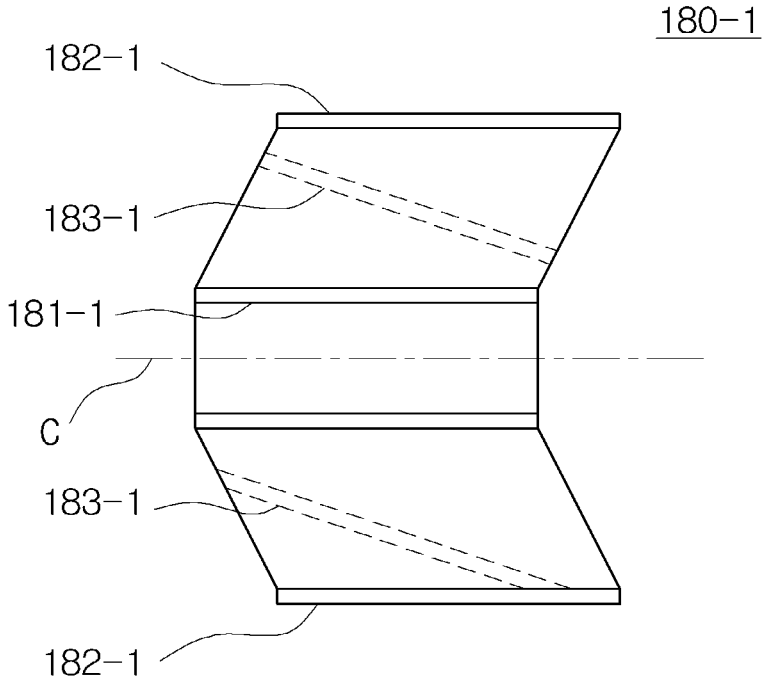

FIGS. 8A and 8B are cross-sectional views of clamping members according to a third embodiment of the present disclosure.

The clamping member according to the third embodiment of the present disclosure may be configured in such a manner that the inner ring 181 and the outer ring 182 of the clamping member 180 are arranged at the same axial position based on the central axis C as illustrated in FIG. 8A, or an inner ring 181-1 and an outer ring 182-1 of a clamping member 180-1 may be arranged at different axial positions as illustrated in FIG. 8B.

The embodiment illustrated in FIG. 8B may be preferable when the support arm 183-1 is not as effective for the spring function when the interval between the inner ring 181-1 and the outer ring 182-1 is smaller than in the embodiment illustrated in FIG. 8A. As illustrated in FIG. 8B, the axial positions of the inner ring 181-1 and the outer ring 182-1 based on the central axis X may be set to deviate from each other, which makes it possible to enhance or maximize the vibration absorption effect.

FIGS. 8A and 8B illustrate that the interval between the inner ring 181 and the outer ring 182 along the central axis C is equal to the interval between the inner ring 181-1 and the outer ring 182-1, but the present disclosure is not limited thereto. An embodiment in which the interval between the inner ring 181 and the outer ring 182 along the central axis C may also be set to be different from the interval between the inner ring 181-1 and the outer ring 182-1.

Figure 9A:
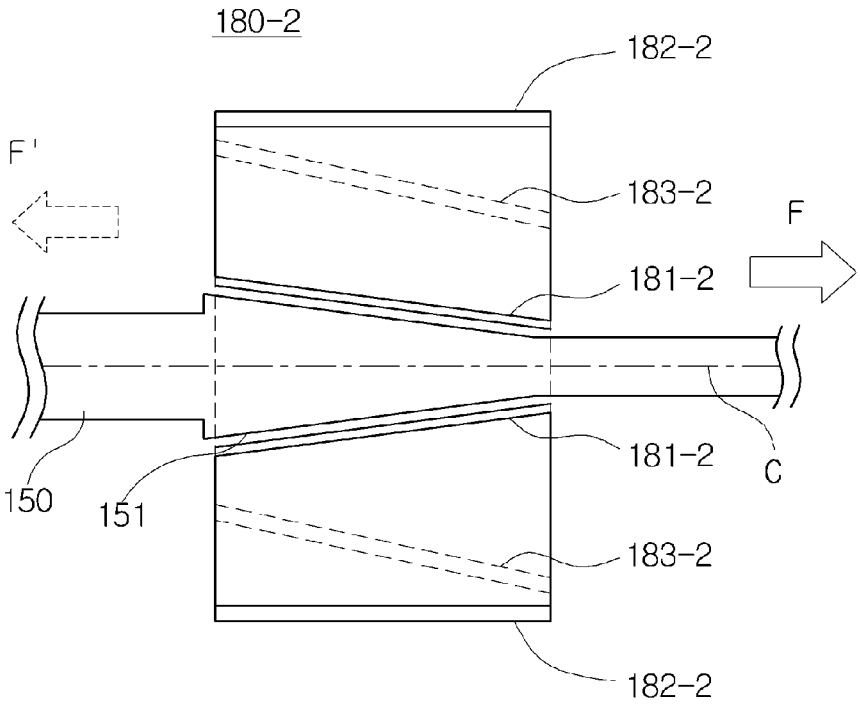
FIGS. 9A and 9B are cross-sectional views of clamping members and tie-bolts according to a fourth embodiment of the present disclosure.
Figure 9B:
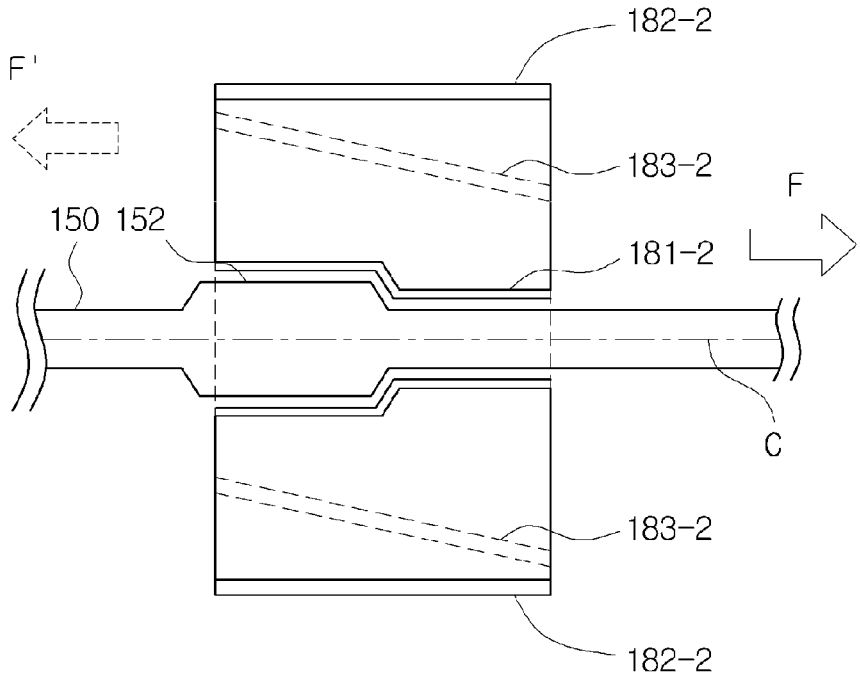

FIGS. 9A and 9B are cross-sectional views of clamping members and tie-bolts according to a fourth embodiment of the present disclosure.

Referring to FIGS. 9A and 9B, an inner ring 181-2 of the clamping member 180-2 according to the fourth embodiment of the present disclosure has a shape in which the inner diameter gradually changes along the central axis C. More specifically, the inner ring 181-2 has a shape of which the inner diameter gradually decreases along the central axis C as illustrated in FIG. 9A, or has a shape of which the inner diameter decreases along the central axis while forming a stepped portion as illustrated in FIG. 9B.

In this case, the tie-bolt 150 according to the fourth embodiment of the present disclosure may include a stopper provided at a position corresponding to the inner ring 181-2 of the clamping member 180-2. More specifically, the tie-bolt 150 may include a stopper having an inclined portion 151 corresponding to the shape of the inner ring 181-2 in which the inner diameter gradually decreases as illustrated in FIG. 9A or a stopper having a stepped portion 152 corresponding to the stepped portion of the inner ring 181-2 as illustrated in FIG. 9B.

As described above, the clamping member 180-2 according to the fourth embodiment of the present disclosure may pressurize cooling air in the flow direction F. Thus, the clamping member 180-2 receives a force in the opposite direction F' of the flow direction F.

Thus, since the inner ring 181-2 of the clamping member 180-2 has a shape of which the inner diameter decreases along the flow direction F and the tie-bolt 150 includes the stopper of which the outer shape corresponds to the shape of the inner ring 181-2 as illustrated in the drawings, the clamping member 180-2 may be reliably fixed to the regular position, even when the tie-bolt 150 is rotated.

FIGS. 9A and 9B illustrate that the outer ring 182-2 has constant inner and outer diameters along the central axis C. However, the outer ring 182-2 may have a shape of which the outer diameter changes along the central axis C, similar to the above-described inner ring 181-2 serving as a unit for fixing the clamping member at the regular position. This structure also belongs to the scope of the present disclosure. In this case, the inner shape of the cooling air pipe contacted with the outer ring 182-2 may be formed to correspond to the outer shape of the outer ring 182-2.

Figure 10A:
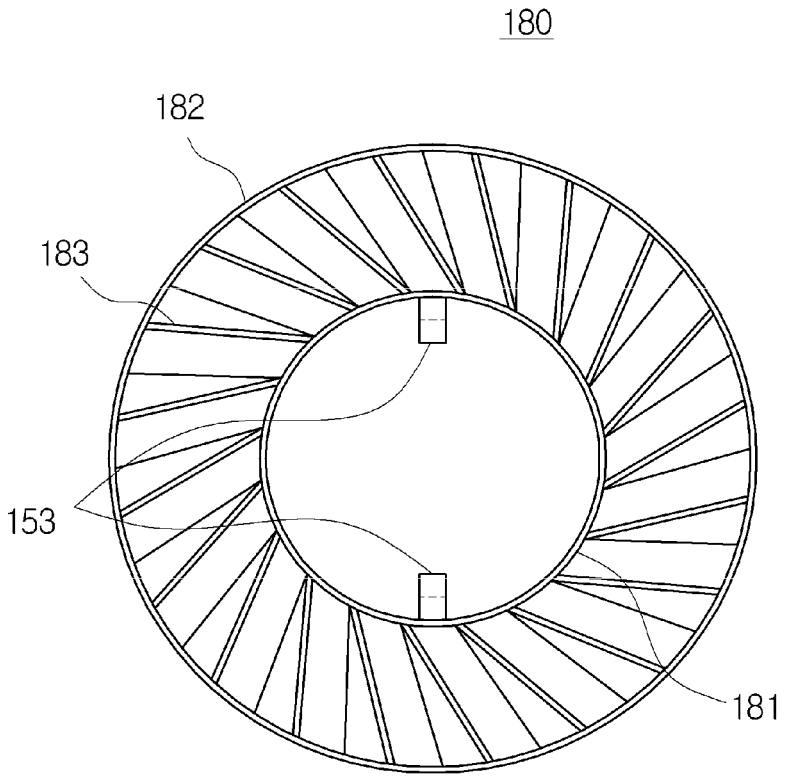
FIGS. 10A and 10B are front and cross-sectional views of a clamping member according to a fifth embodiment of the present disclosure.
Figure 10B:
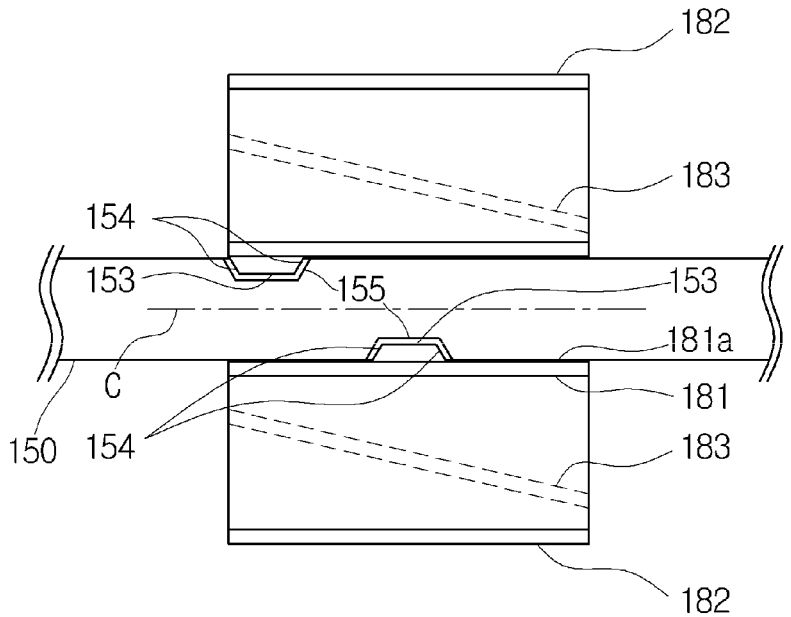

FIGS. 10A and 10B are front and cross-sectional views of a clamping member according to a fifth embodiment of the present invention, illustrating another fixing unit for the clamping member.

Referring to FIGS. 10A and 10B, the clamping member 180 according to the fifth embodiment of the present disclosure may include one or more stopper protrusions 153 protruding from the inner circumferential surface of the inner ring 181 toward the inside, and the tie-bolt may include a groove 155 formed at a position corresponding to the stopper protrusion 153.

Through such a structure, the clamping member 180 may be reliably fixed to the regular position of the tie-bolt. Thus, even when the tie-bolt is rotated, the clamping member 180 may be substantially prevented from coming off.

FIGS. 10A and 10B illustrate that two stopper protrusions 153 are formed to have different protrusion heights and different lengths in the axial direction, but the present disclosure is not limited thereto. The clamping member 180 may include stopper protrusions having different shapes, and this structure may also belong to the scope of the present invention.

As illustrated in FIGS. 10A and 10B, the front and rear ends of the stopper protrusion 153 may be formed with inclined surfaces 154 to guide the insertion of the stopper protrusion 153 into the groove 155.

Although not illustrated, the clamping member 180 may include one or more stopper protrusions arranged on the outer surface of the outer ring 182 so as to protrude toward the outside, similar to the above-described structure, and the cooling air pipe may include one or more grooves formed at positions corresponding to the stopper protrusions. Then, the clamping member 180 may be fixed to the regular position.

Figure 11A:
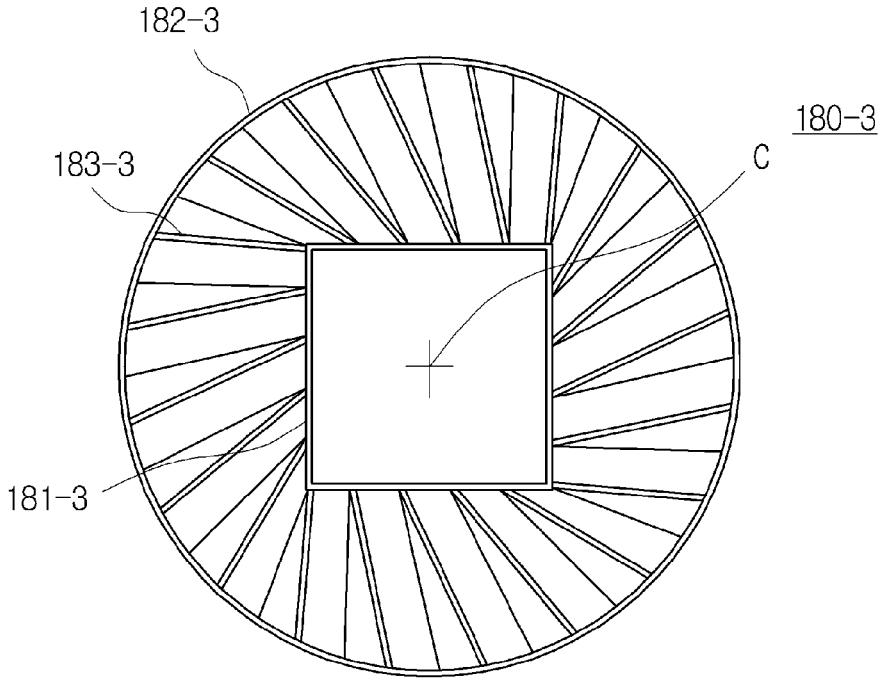
FIGS. 11A and 11B are front views of a clamping member according to a sixth embodiment of the present disclosure.
Figure 11B:
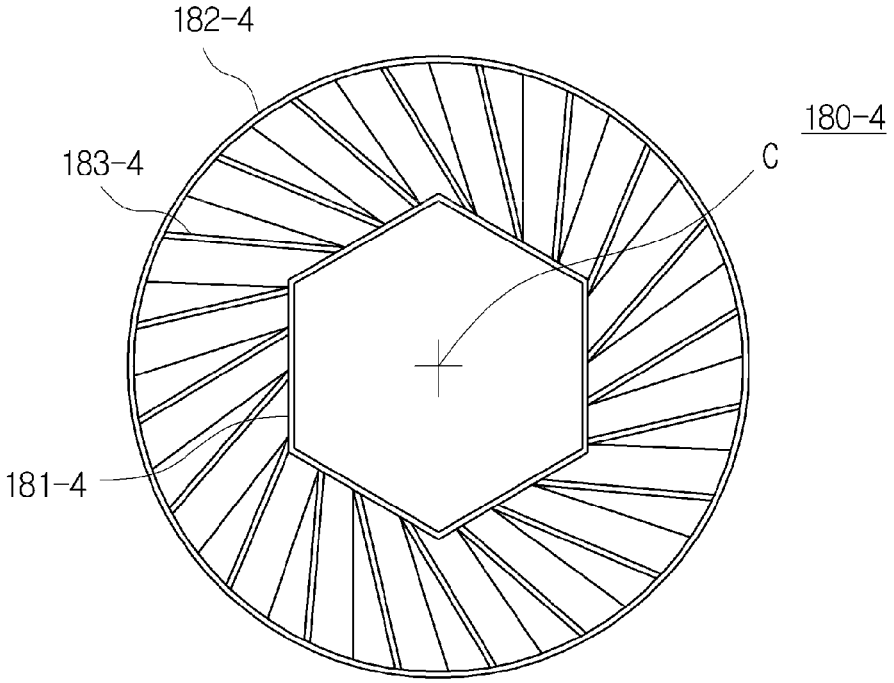

FIGS. 11A and 11B are front views of a clamping member according to a sixth embodiment of the present disclosure, illustrating a component for preventing slip between the clamping member and the tie-bolt.

Referring to FIGS. 11A and 11B, the clamping member 180-3 or 180-4 according to the sixth embodiment of the present disclosure include an inner ring 181-3 or 181-4 in which the cross-section in a direction perpendicular to the central axis C has a polygonal shape, and a portion of the tie-bolt corresponding to the inner ring has the same polygonal cross-sectional shape as the inner ring 181-3 or 181-4.

As described above, the clamping member 180-3 or 180-4 according to the sixth embodiment of the present disclosure may pressurize cooling air in the flow direction. Thus, the clamping member 180-3 or 180-4 receives a force in the opposite direction of the flow direction, and simultaneously generates a load to pressurize the cooling air. In this case, slip may occur between the inner ring 181-3 or 181-4 of the clamping member 180-3 or 180-4 and the outer circumferential surface of the tie-bolt.

Thus, when the inner ring 181-3 or 181-4 of the clamping member 180-3 or 180-4 according to the sixth embodiment of the present disclosure is formed to have a polygonal cross-sectional shape in the direction perpendicular to the central axis C and the portion of the tie-bolt corresponding to the inner ring is formed to have the same polygonal cross-sectional shape as the inner ring 181-3 or 181-4, it is possible to substantially prevent slip between the inner ring 181-3 or 181-4 of the clamping member 180-3 or 180-4 and the outer circumferential surface of the tie-bolt.

FIG. 11A illustrates the inner ring 181-3 having a rectangular cross-section, and FIG. 11B illustrates the inner ring 181-4 having a hexagonal cross-section. However, the present disclosure is not limited thereto, and an inner ring having a different cross-sectional shape and a tie-bolt having a cross-sectional shape corresponding to the cross-sectional shape of the inner ring also belong to the scope of the present disclosure.

In another embodiment, the outer ring 182-3 or 182-4 of the clamping members 180-3 or 180-4 may be formed to have a polygonal cross-sectional shape, and the inner circumferential surface of the cooling air pipe may also be formed to have a polygonal cross-sectional shape corresponding to the outer ring, similar to the cross-sectional shapes of the inner ring 181-3 or 181-4.

Figure 12:
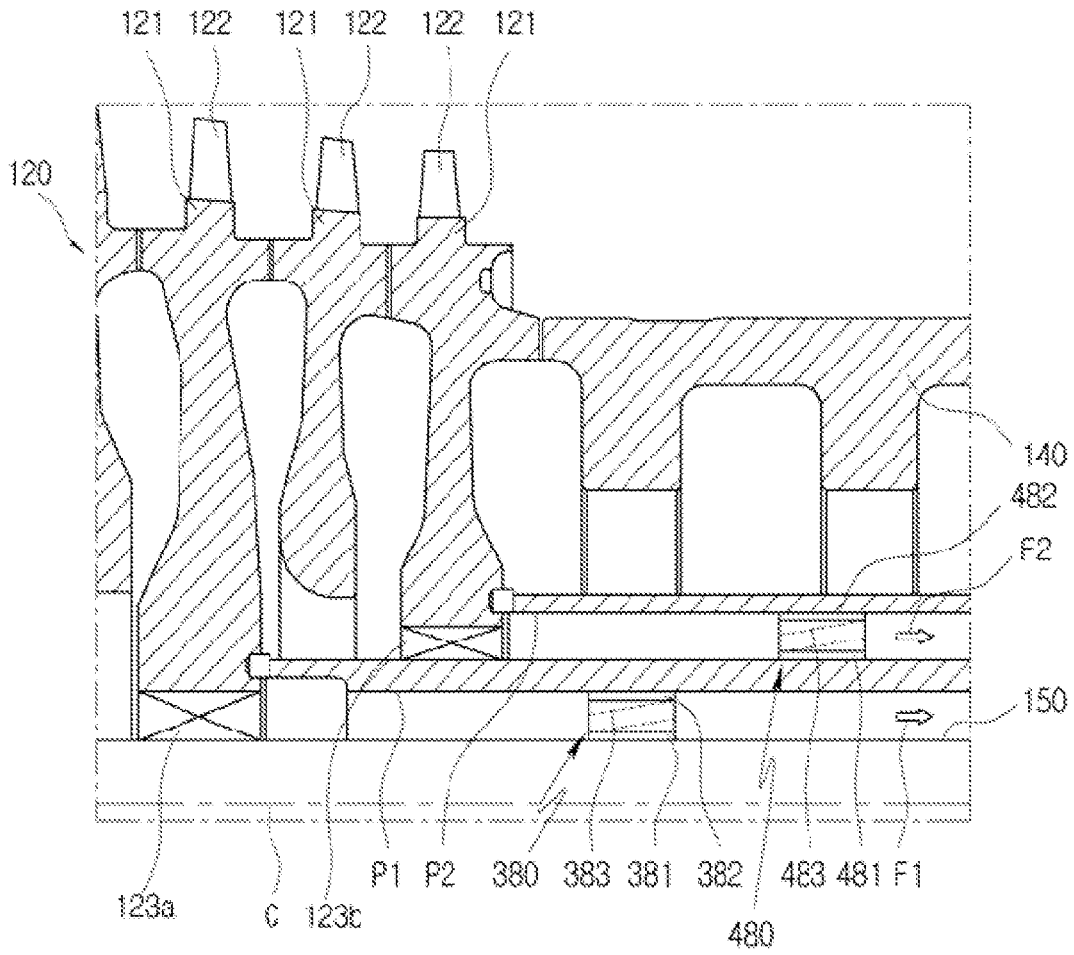
FIGS. 12 to 14 are cross-sectional views of rotor assemblies each including two or more clamping members according to the embodiments of the present disclosure.
Figure 13:
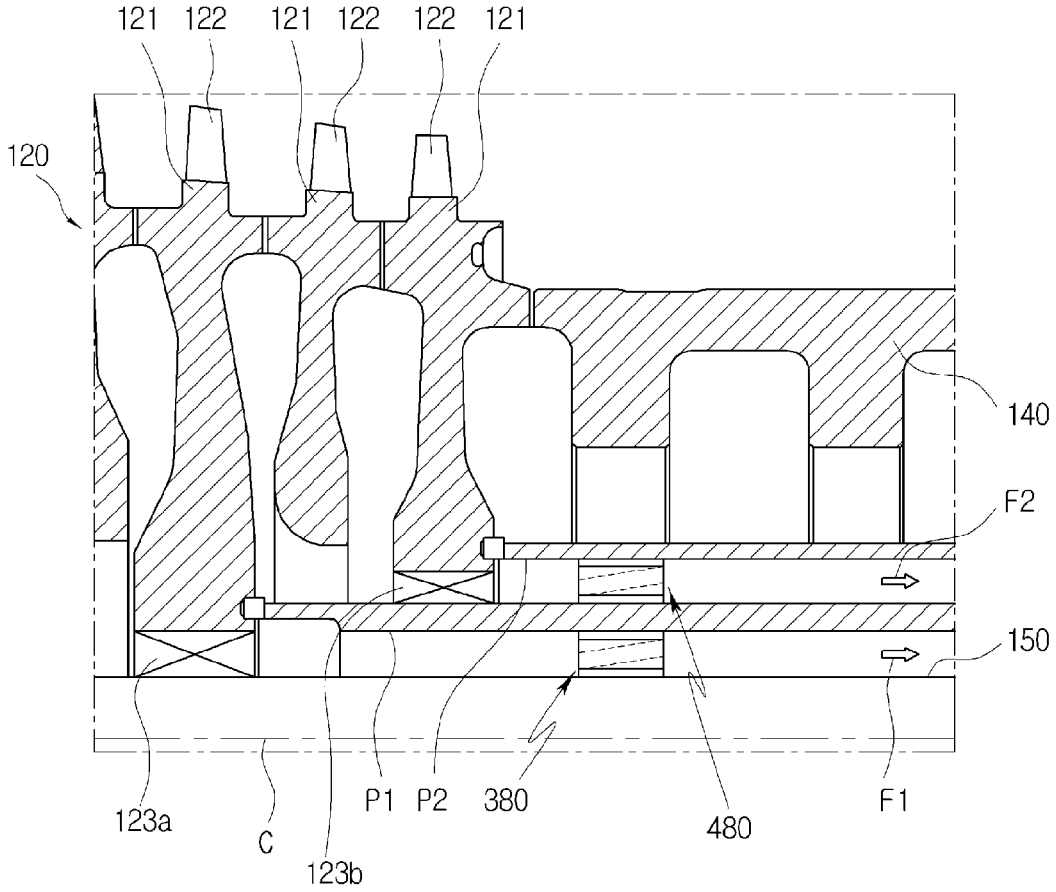
Figure 14:
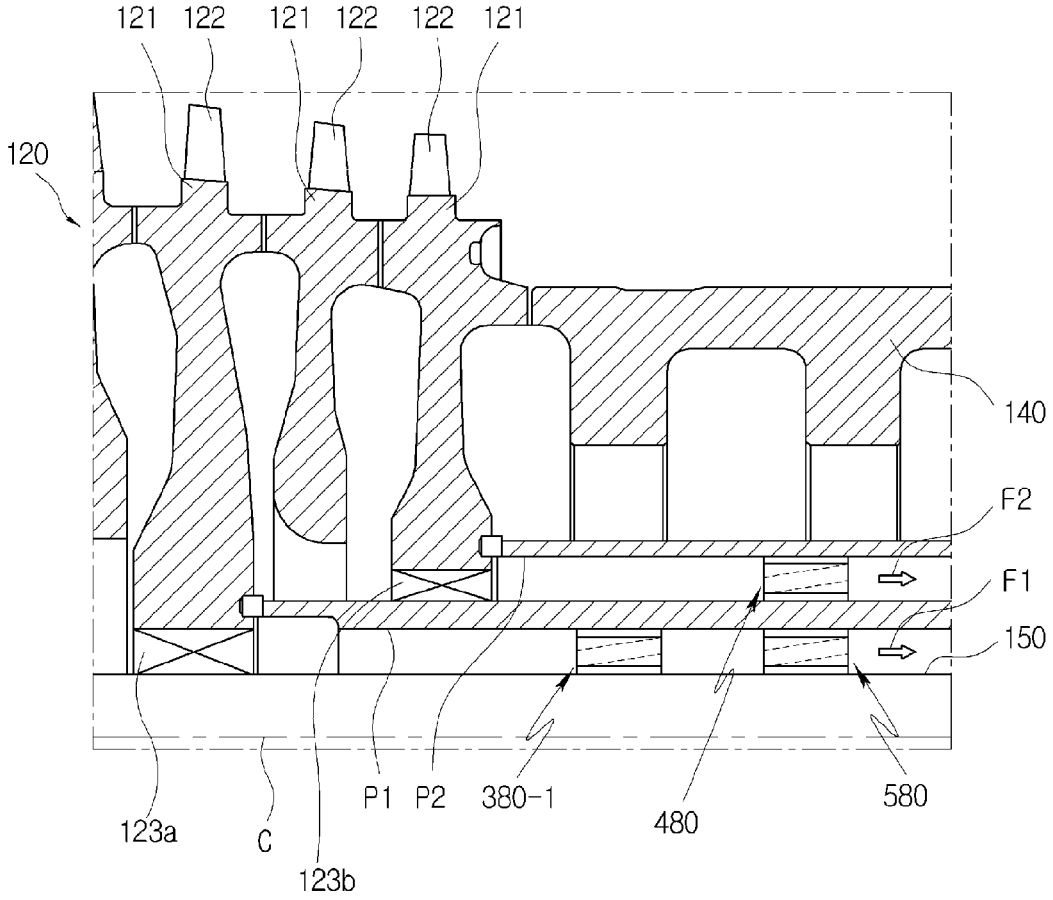

FIGS. 12 to 14 are cross-sectional views of rotor assemblies each including two or more clamping members according to another embodiment of the present disclosure.

The detailed descriptions of components already discussed in the above-described embodiments will be omitted for brevity.

Referring to FIGS. 12 and 13, a gas turbine includes a first cooling air pipe P1, a second cooling air pipe P2, a first clamping member 380, and a second clamping member 480. The first cooling air pipe P1 has a tie-bolt 150 arranged therethrough and forms a first ring-shaped cooling air flow path F1 in the internal space thereof with the tie-bolt 150 through which cooling air is passed. The second cooling air pipe P2 has the first cooling air pipe P1 arranged therethrough and forms a second ring-shaped cooling air flow path F2 in the internal space thereof with the first cooling air pipe P1 through which cooling is passed. The first clamping member 380 is arranged in the first ring-shaped cooling air flow path F1 so as to support the tie-bolt 150 with respect to the first cooling air pipe P1. The second clamping member 480 is arranged in the second ring-shaped cooling air flow path F2 so as to support the first cooling air pipe P1 with respect to the second cooling air pipe P2. The first and second clamping members 380 and 480 may be rotated to pressurize the cooling air.

The embodiments illustrated in FIGS. 12 and 13 correspond to components for forming separate cooling air flow paths F1 and F2 using the two cooling air pipes P1 and P2 and the tie-bolt 150, in order to transfer cooling air extracted from compressor rotor disks 121 at different positions.

That is, a part of the air pressurized by the compressor rotor 120 may be extracted from the compressor rotor disk 121 and pressurized and transferred to the turbine rotor disk through the first and second cooling air pipes P1 and P2. The cooling air passing through the first cooling air pipe P1 and the cooling air passing through the second cooling air pipe P2 are extracted from compressor rotor disks 121 at different positions, pressurized through the first and second clamping members 380 and 480, and transferred to the turbine rotor disk.

In this case, in order to reduce or prevent leakage and mixing of the extracted air, the first cooling air pipe P1 arranged adjacent to the central axis C is connected to a through-hole 123*a* of a compressor rotor disk 121 arranged at the upstream side in the flow direction of the air compressed by the compressor blade 122 of the compressor rotor, and the second cooling air pipe P2 provided outside the first cooling air pipe P1 is connected to a through-hole 123*b* of a compressor rotor disk 121 arranged at the downstream side. The cooling air passing through the first cooling air pipe P1 may be extracted at a first extraction position corresponding to the upstream side, and the cooling air passing through the second cooling air pipe P2 may be extracted at a second extraction position corresponding to the downstream side from the first extraction position.

As such, when the cooling air extracted from the compressor rotor disks is compressed while passing through the clamping members 380 and 480, the cooling air may be supplied to turbine rotor disks at different positions in the turbine rotor. Furthermore, the extraction positions may be moved toward the front side so as to utilize low-temperature and low-pressure compressed air as cooling air. Thus, the turbine cooling performance and the entire performance of the gas turbine may be improved.

The first clamping member 380 to support the tie-bolt 150 with respect to the first cooling air pipe P1 and the second clamping member 480 to support the first cooling air pipe P1 with respect to the second cooling air pipe P2 are arranged at positions corresponding to the above-described hollow shaft, in order to support portions corresponding to the hollow shaft.

The first and second clamping members 380 and 480 may be arranged at the same axial position or different axial positions in the range corresponding to the hollow shaft.

That is, as illustrated in FIG. 12, the first clamping member 380 which pressurizes relatively low-pressure cooling air and is arranged in the first cooling air flow path F1, which is longer than the second cooling air flow path F2, may be arranged at the upstream side from the second clamping member 480. More specifically, the first clamping member 380 may be arranged at an axial position which is more adjacent to the compressor rotor 120 than the second clamping member 480.

Furthermore, in order to improve the vibration absorption and damping effect, the first and second clamping members 380 and 480 may be arranged at the same axial position, as illustrated in FIG. 13. In this case, the air blowing capacity of the first clamping member 380 may be set to be higher than the air blowing capacity of the second clamping member 480, in consideration of the pressure of cooling air in the first cooling air flow path F1 and the length of the first cooling air flow path F1.

The structure in which the air blowing capacity of the first clamping member 380 is set to be different from the air blowing capacity of the second clamping member 480 will be described below with reference to FIGS. 15 to 17B.

FIG. 14 illustrates a structure including three clamping members.

Referring to FIG. 14, the gas turbine according to another embodiment of the present disclosure further includes a third clamping member 580 which is arranged in the first ring-shaped cooling air flow path F1 so as to support the tie-bolt 150 with respect to the first cooling air pipe P1. The third clamping member 580 is arranged at the rear of the first clamping member 380 along the central axis C.

That is, in order to pressurize relatively low-pressure cooling air and compensate for a pressure loss of cooling air in the downstream side (right side of FIG. 14) of the first clamping member 380 arranged in the first cooling air flow path F1 longer than the second cooling air flow path F2, the third clamping member 580 may be additionally provided at the downstream side of the first cooling air flow path F1 of the first clamping member 380.

Furthermore, as the third clamping member 580 is additionally provided, the vibration absorption and damping effect of the tie-bolt 150 may be improved.

Figure 15:
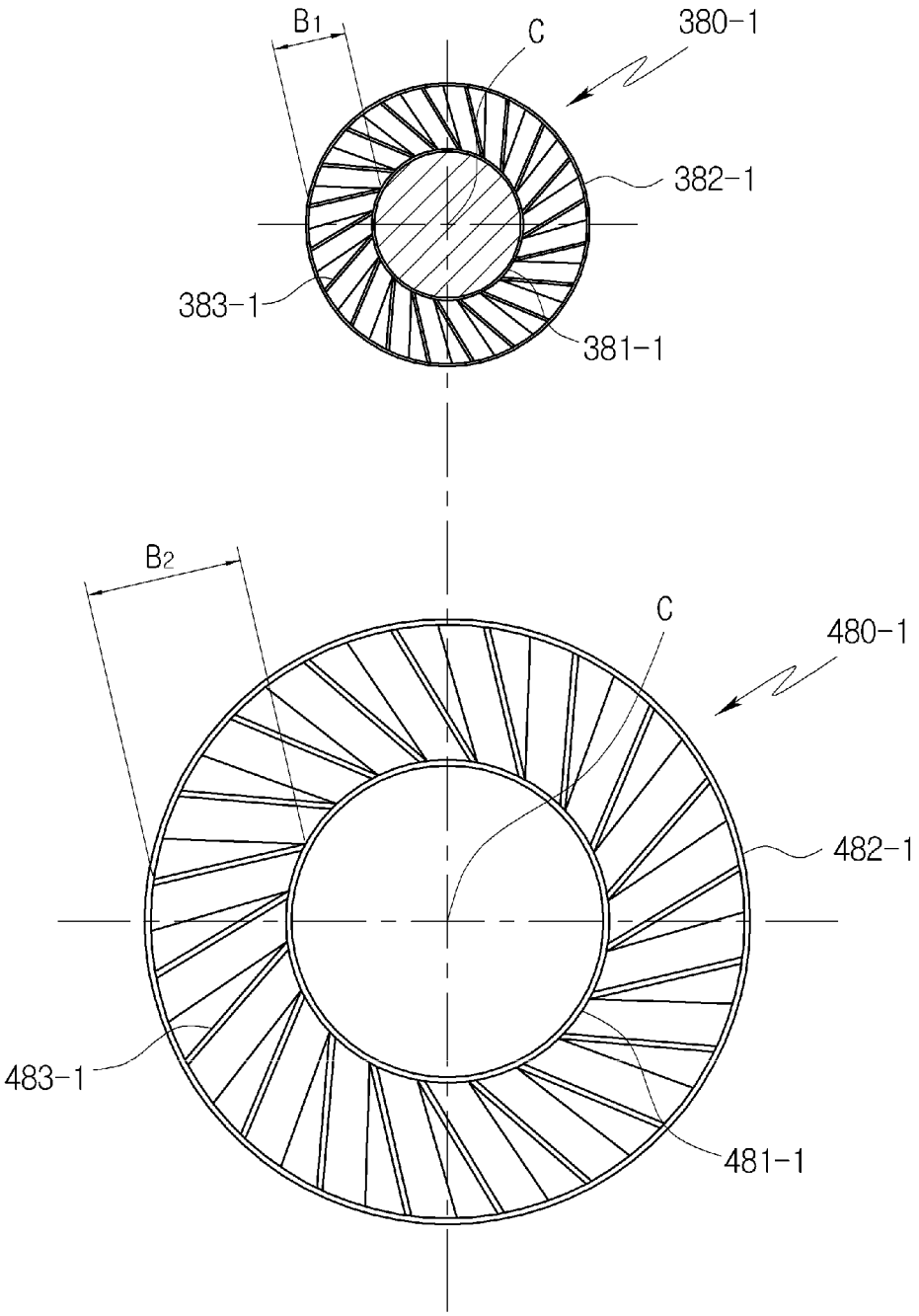
FIGS. 15, 16, 17A and 17B are front views of a structure to which clamping members having different air blowing capacities are applied according to the embodiments of the present disclosure.
Figure 16:
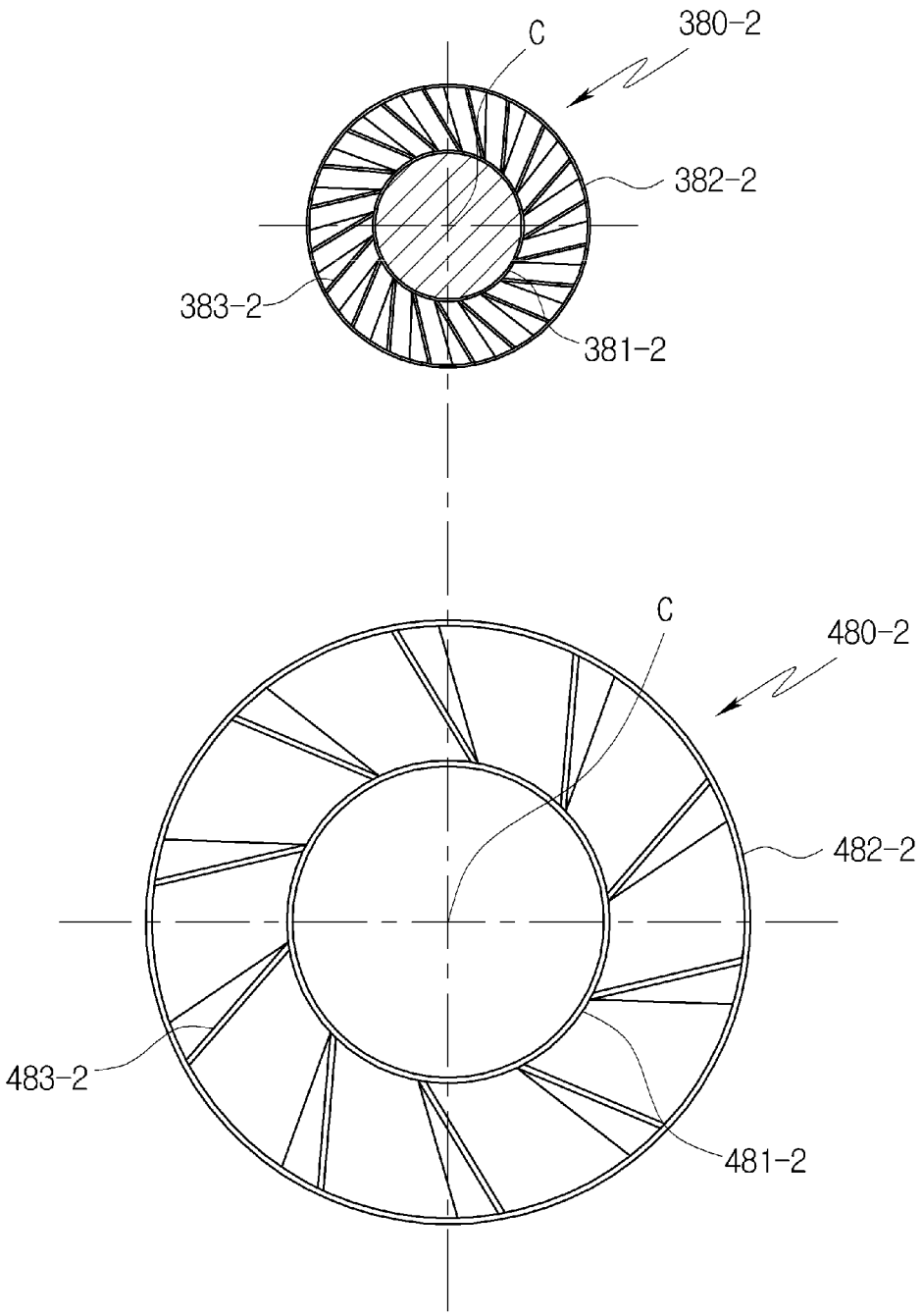

FIGS. 15 and 16 are front views of a structure to which clamping members having different air blowing capacities are applied according to another embodiment of the present disclosure.

First, referring to FIG. 15, a first clamping member 380-1 includes a first inner ring 381-1 closely attached to the outer circumferential surface of the tie-bolt, a first outer ring 382-1 closely attached to the inner circumferential surface of the first cooling air pipe, and a plurality of first support arms 383-1 each having one end connected to the first inner ring 381-1 and the other end connected to the first outer ring 382. The second clamping member 480-1 includes a second inner ring 481-1 closely attached to the outer circumferential surface of the first cooling air pipe, a second outer ring 482-1 closely attached to the inner circumferential surface of the second cooling air pipe. A plurality of second support arms 483-1 each have one end connected to the second inner ring 481-1 and the other end connected to the second outer ring 482-1. The first support arms 383-1 and the second support arms 483-1 are configured to have an impeller shape for pressurizing the cooling air.

The first and second clamping members 380-1 and 480-1 may be set to have the same air blowing capacity or different air blowing capacities.

In order to set different air blow capacities for the first and second claiming members 380-1 and 480-1, the radial length of the first support arm 383-1 of the first clamping member 380-1 may be set differently from the radial length of the second support arm 483-1 of the second clamping member 480-1, or the number of first support arms 383-1 of the first clamping member 380-1 may be set to be different from the number of second support arms 483-1 of the second clamping member 480-1.

FIG. 15 illustrates an embodiment in which the radial length of the first support arm 383-1 of the first clamping member 380-1 is set to be different from the radial length of the second support arm 483-1 of the second clamping member 480-1.

That is, as illustrated in FIG. 15, the length B1 of the first support arm 383-1 provided between the first inner ring 381-1 and the first outer ring 382-1 may be set to be different from the length B2 of the second support arm 483-1 provided between the second inner ring 481-1 and the second outer ring 482-1. Thus, the air blowing capacity of the first clamping member 380-1 may be set to be different from the air blowing capacity of the second clamping member 480-1.

FIG. 15 illustrates that the length B2 of the second support arm 483-1 is set to be larger than the length B1 of the first support arm 383-1. However, the length B1 of the first support arm 383-1 may be set to be larger than the length B2 of the second support arm 483-1.

FIG. 16 illustrates an embodiment in which the number of first support arms 383-2 of the first clamping member 380-2 is set to be different from the number of second support arms 483-2 of the second clamping member 480-2.

That is, as illustrated in FIG. 16, the number of first support arms 383-2 provided between the first inner ring 381-2 and the first outer ring 382-2 may be set to be different from the number of second support arms 483-2 provided between the second inner ring 481-2 and the second outer ring 482-2. Thus, the air blowing capacity of the first clamping member 380-1 may be set to be different from the air blowing capacity of the second clamping member 480-1.

In the embodiment of FIG. 16, the number of first support arms 383-2 is set to be larger than the number of second support arms 483-2. However, the number of second support arms 483-2 may be set to be larger than the number of first support arms 383-2.

That is, according to the air blowing capacities required by the first and second clamping members 380-2 and 480-2, respectively, the number of first support arts 383-2 and the number of second support arms 483-2 may be separately adjusted. In this case, the spring effect of the support arms 383-2 and 483-2 may be adjusted.

Figure 17A:
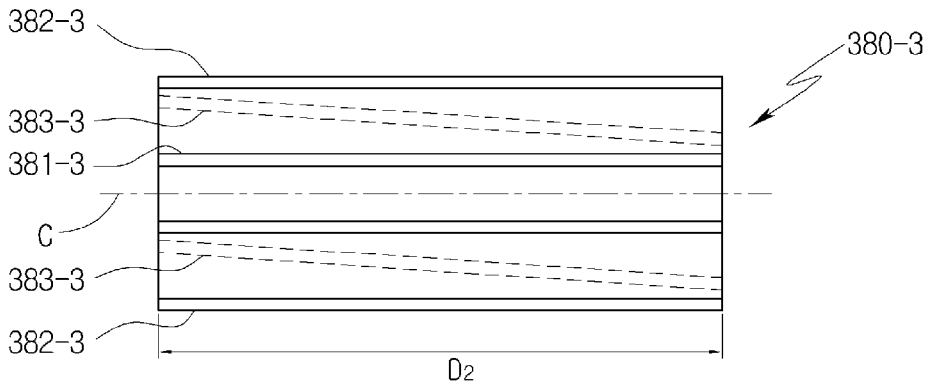
Figure 17B:
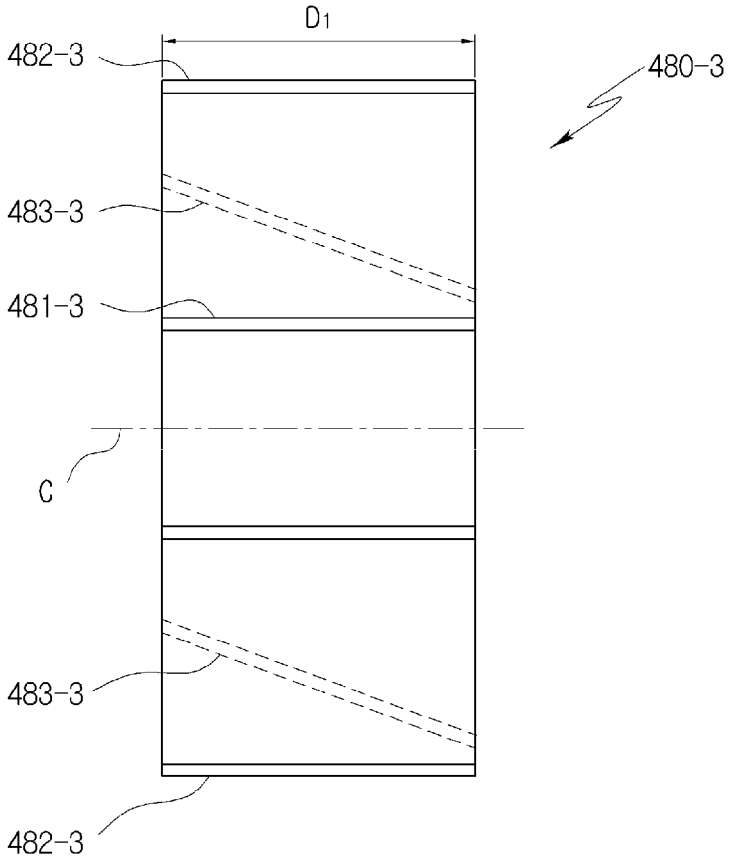

FIGS. 17A and 17B illustrate an embodiment in which the axial widths of the first and second clamping members 380-3 and 480-3 based on the central axis C are set to be different from each other to set different air blowing capacities for the first and second clamping members 380-3 and 480-4.

That is, as illustrated in FIGS. 17A and 17B, the axial width D1 of the first clamping member 380-3 and the axial width D2 of the second clamping member 480-3 may be set to be different from each other. More specifically, as the axial width D1 of the first support arm 383-3 provided between the first inner ring 381-3 and the first outer ring 382-3 is set to be different from the axial width D2 of the second support arm 483-3 provided between the second inner ring 481-3 and the second outer ring 482-3, the air blowing capacity of the first clamping member 380-3 may be set to be different from the air blowing capacity of the second clamping member 480-3.

In the embodiment illustrated in FIGS. 17A and 17B, the axial width D1 of the first support arm 383-3 is set to be larger than the axial width D2 of the second support arm 483-3. However, the axial width D2 of the second support arm 483-3 may be set to be larger than the axial width D1 of the first support arm 383-3. This structure may also belong to the scope of the present disclosure.

According to the embodiment of the present disclosure, the gas turbine may support the tie-bolt to effectively reduce vibrations using the clamping member arranged in the cooling air flow path on the outer circumferential surface of the tie-bolt, pressurize the cooling air extracted from the compressor rotor, and transfer the pressurized cooling air to the turbine rotor, thereby increasing the entire efficiency.

Furthermore, the gas turbine may cool the high-temperature turbine rotor through the air extracted from the low-pressure compressor rotor using the plurality of clamping members having the same or different air blowing capacities, thereby increasing the entire efficiency.

While the present invention has been described with respect to the specific embodiments, it will be apparent to those skilled in the art that various changes and modifications may be made without departing from the spirit and scope of the invention as defined in the following claims.

The embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A gas turbine comprising:

a rotor unit including a plurality of rotor disks and a plurality of rotor blades, the rotor blades being respectively arranged on outer circumferential surfaces of the rotor disks;

a tie-bolt disposed along a central axis of the rotor unit and passing through the rotor disks, the tie-bolt being operable to fasten the rotor disks;

a cooling air pipe, the tie-bolt being disposed in the cooling air pipe thereby defining a ring-shaped cooling air flow path in an internal space between the cooling air pipe and the tie-bolt, the ring-shaped cooling air flow path being operable to pass cooling air therethrough; and a clamping member disposed in the ring-shaped cooling air flow path and operable to support the tie-bolt with respect to the cooling air pipe, to pass the cooling air therethrough, and to pressurize the cooling air when the clamping member is rotated, wherein the clamping member includes an inner ring having an inner circumferential surface and an outer circumferential surface, an outer ring having an inner circumferential surface and an outer circumferential surface, and a plurality of support arms each having one end connected to the outer circumferential surface of the inner ring and another end connected to the inner surface of the outer ring.

2. The gas turbine according to claim 1, wherein the rotor unit includes a compressor rotor, a turbine rotor, and a hollow shaft which couples the compressor rotor and the turbine rotor, and the cooling air pipe extends from a compressor rotor disk through the hollow shaft to a turbine rotor disk.

3. The gas turbine according to claim 1, wherein the inner circumferential surface of the inner ring is in contact with an outer circumferential surface of the tie-bolt, the outer circumferential surface of the outer ring is in contact with an inner circumferential surface of the cooling air pipe, and the plurality of support arms are configured in an impeller shape to pressurize the cooling air when rotated.

4. The gas turbine according to claim 1, wherein at least one of a leading edge and a trailing edge of one of the support arms has a linear shape, and an extension of the linear shaped leading edge or the linear shaped trailing edge forms a crossing angle with respect to a straight line perpendicular to and passing through the central axis.

5. The gas turbine according to claim 1, wherein at least one of a leading edge and a trailing edge of one of the support arms has a curved shape, and an extension passing through ends of the curved shaped leading edge or the curved shaped trailing edge forms a crossing angle with respect to a straight line perpendicular to and passing through the central axis.

6. The gas turbine according to claim 1, wherein the inner ring and the outer ring are disposed at a same axial position.

7. The gas turbine according to claim 1, wherein the inner ring has a shape in which an inner diameter of the inner ring decreases along the central axis, and the tie-bolt includes a stopper having a shape corresponding to the shape of the inner ring.

8. The gas turbine according to claim 1, wherein the inner ring has a shape in which an inner diameter of the inner ring decreases along the central axis forming a stepped portion, and the tie-bolt includes a stopper having a shape corresponding to the stepped portion of the inner ring.

9. The gas turbine according to claim 1, wherein the clamping member includes one or more stopper protrusions extending from an inner surface of the inner ring toward the central axis, and the tie-bolt includes a groove defined at a position corresponding to the one or more stopper protrusions.

10. A gas turbine comprising:

a rotor unit including a plurality of rotor disks and a plurality of rotor blades, the rotor blades respectively arranged on outer circumferential surfaces of the rotor disks;

a tie-bolt disposed through the rotor disks, the tie-bolt being operable to fasten the rotor disks;

a first cooling air pipe, the tie-bolt being disposed in the first cooling air pipe thereby defining a first ring-shaped cooling air flow path in an internal space between the first cooling air pipe and the tie-bolt, the first ring-shaped cooling air flow path being operable to pass a portion of cooling air;

a second cooling air pipe, the first cooling air pipe being disposed in the second cooling air pipe thereby defining a second ring-shaped cooling air flow path in an internal space between the second cooling air pipe and the first cooling air pipe, the second ring-shaped cooling air flow path being operable to pass a portion of the cooling air;

a first clamping member disposed in the first ring-shaped cooling air flow path and operable to support the tie-bolt with respect to the first cooling air pipe; and a second clamping member disposed in the second ring-shaped cooling air flow path and operable to support the first cooling air pipe with respect to the second cooling air pipe, wherein the first and second clamping members are operable to pass the cooling air therethrough, and the first and second clamping members are operable to pressurize the cooling air when rotated, wherein the first and second clamping members each include an inner ring having an inner circumferential surface and an outer circumferential surface, an outer ring having an inner circumferential surface and an outer circumferential surface, and a plurality of support arms each having one end connected to the outer circumferential surface of the inner ring and another end connected to the inner surface of the outer ring.

11. The gas turbine according to claim 10, wherein the rotor unit includes a compressor rotor, a turbine rotor, and a hollow shaft which couples the compressor rotor and the turbine rotor, and the first and second cooling air pipes respectively extended from a compressor rotor disk through the hollow shaft to a turbine rotor disk.

12. The gas turbine according to claim 11, wherein the compressor rotor includes a plurality of compressor rotor disks and the turbine rotor comprises a plurality of turbine rotor disks, and the compressor rotor is operable to pressurize a portion of the cooling air by extracting the portion of the cooling air from one of the compressor rotor disks, pressurizing the portion of the cooling air, and transferring the pressurized portion of the cooling air to one of the turbine rotor disks through the first and second cooling air pipes.

13. The gas turbine according to claim 12, wherein the rotor unit is operable to extract the portion of the cooling air passing through the first cooling air pipe and the portion of the cooling air passing through the second cooling air pipe from the compressor rotor disk, pressurize the extracted cooling air, and transfer the pressurized cooling air to one of the turbine rotor disks, and the rotor unit is operable to extract the portion of the cooling air passing through the first cooling air pipe and the portion of the cooling air passing through the second cooling air pipe from different extraction positions.

14. The gas turbine according to claim 13, wherein the compressor rotor includes a first extraction position operable to extract the portion of the cooling air passing through the first cooling air pipe, the compressor rotor includes a second extraction position operable to extract the portion of the cooling air passing through the second cooling air pipe, and the first extraction position is disposed at an upstream side of the second extraction position.

15. The gas turbine according to claim 11, wherein the first clamping member is arranged at a central axial position closer to the compressor rotor than the second clamping member.

16. The gas turbine according to claim 10, wherein the inner circumferential surface of the first inner ring is in contact with an outer circumferential surface of the tie-bolt, the outer circumferential surface of the first outer ring is in contact with an inner circumferential surface of the first cooling air pipe, and the inner circumferential surface of the second inner ring is in contact with an outer circumferential surface of the first cooling air pipe;

the outer circumferential surface of the second outer ring is in contact with an inner circumferential surface of the second cooling air pipe, and the first plurality of support arms and the second plurality of support arms are each configured in an impeller shape to pressurize the cooling air when rotated.

17. The gas turbine according to claim 10, wherein the first and second clamping members have different air blowing capacities from each other.

18. The gas turbine according to claim 10, wherein a count of the first plurality of support arms of the first clamping member is different from a count of the second plurality of support arms of the second clamping member.

19. The gas turbine according to claim 10, wherein a radial length of one of the first plurality of support arms is different from a radial length of one of the second plurality of support arms.

20. The gas turbine according to claim 10, wherein a central axial width of one of the first plurality of support arms is different from a central axial width of one of the second plurality of support arms.

* * * * *